US009951402B2

(12) United States Patent
Ando et al.

(10) Patent No.: US 9,951,402 B2
(45) Date of Patent: Apr. 24, 2018

(54) HARD PARTICLES FOR INCORPORATION IN SINTERED ALLOY AND WEAR-RESISTANT IRON-BASED SINTERED ALLOY AND PRODUCTION METHOD THEREOF

(71) Applicants: Kimihiko Ando, Toyota (JP); Nobuyuki Shinohara, Tajimi (JP)

(72) Inventors: Kimihiko Ando, Toyota (JP); Nobuyuki Shinohara, Tajimi (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 390 days.

(21) Appl. No.: 14/423,805

(22) PCT Filed: Oct. 30, 2013

(86) PCT No.: PCT/IB2013/002414

§ 371 (c)(1),
(2) Date: Feb. 25, 2015

(87) PCT Pub. No.: WO2014/076530

PCT Pub. Date: May 22, 2014

(65) Prior Publication Data

US 2015/0211097 A1 Jul. 30, 2015

(30) Foreign Application Priority Data

Nov. 14, 2012 (JP) ..... 2012-250500

(51) Int. Cl.
*C22C 27/04* (2006.01)
*C22C 33/02* (2006.01)
(Continued)

(52) U.S. Cl.
CPC ..... *C22C 33/0278* (2013.01); *B22F 3/12* (2013.01); *C22C 1/045* (2013.01); *C22C 27/04* (2013.01);
(Continued)

(58) Field of Classification Search
CPC ..... B22F 3/12; C22C 33/0207
(Continued)

(56) References Cited

U.S. PATENT DOCUMENTS 3,841,846 A * 10/1974 Larsen ..... C22C 27/04 164/349
6,613,120 B2 * 9/2003 Ando ..... C22C 33/0207 419/11
(Continued)

FOREIGN PATENT DOCUMENTS

CN 1847442 A 10/2006
DE 24 56 781 A1 7/1976
(Continued)

OTHER PUBLICATIONS

Kimihiko Ando et al.: "Development of Sintered Valve Seat Insert for Gasoline Engines with Increased Exhaust Gas Temperature", Jidosha Gijutsukai Ronbunshu, vol. 35, No. 3, Jul. 2004, pp. 143-147.

*Primary Examiner* — Colleen P Dunn
*Assistant Examiner* — Rajinder Bajwa
(74) *Attorney, Agent, or Firm* — Sughrue Mion, PLLC

(57) ABSTRACT

Hard particles are incorporated as a starting material in a sintered alloy. The hard particles contain 20 to 60 mass % Mo and 3 to 15 mass % Mn, the balance being Fe and unavoidable impurities.

3 Claims, 3 Drawing Sheets

| | HARD PARTICLE COMPONENTS, MASS% (BALANCE = IRON AND UNAVOIDABLE IMPURITIES) | | | | | | | INITIAL OXIDATION TEMPERATURE (°C) | HARDNESS Hv | PROCESS | PARTICLE DIAMETER |
|---|---|---|---|---|---|---|---|---|---|---|---|
| | Mo | Mn | Ni | Co | Cr | C | Si | | | | |
| EXAMPLE 1 | 22 | 6 | | | | | | 690 | 230 | GAS ATOMIZATION | 45-180 μm |
| EXAMPLE 2 | 40 | 6 | | | | | | 600 | 250 | GAS ATOMIZATION | 45-180 μm |
| EXAMPLE 3 | 55 | 6 | | | | | | 515 | 400 | GAS ATOMIZATION | 45-180 μm |
| EXAMPLE 4 | 40 | 3 | | | | | | 630 | 240 | GAS ATOMIZATION | 45-180 μm |
| EXAMPLE 5 | 40 | 12 | | | | | | 600 | 290 | GAS ATOMIZATION | 45-180 μm |
| EXAMPLE 6 | 40 | 6 | | | | 0.4 | | 630 | 500 | GAS ATOMIZATION | 45-180 μm |
| EXAMPLE 7 | 40 | 6 | | | | 0.02 | | 607 | 247 | GAS ATOMIZATION | 45-180 μm |
| COMPARATIVE EXAMPLE 1 | 40 | 6 | | | | 1.5 | | 640 | 1200 | GAS ATOMIZATION | 45-180 μm |
| COMPARATIVE EXAMPLE 2 | 15 | 6 | | | | | | 790 | 200 | GAS ATOMIZATION | 45-180 μm |
| COMPARATIVE EXAMPLE 3 | 70 | 6 | | | | | | 500 | 750 | GAS ATOMIZATION | 45-180 μm |
| COMPARATIVE EXAMPLE 4 | 40 | 6 | 12 | | | 1.5 | | 600 | 790 | GAS ATOMIZATION | 45-180 μm |
| COMPARATIVE EXAMPLE 5 | 63 | | | | | | 1.1 | 580 | 1000 | PULVERIZATION | NOT MORE THAN 150 μm |
| COMPARATIVE EXAMPLE 6 | 28 | | 0.3 | 60 | 9 | 0.07 | 2.2 | 750 | 850 | GAS ATOMIZATION | 45-180 μm |

(51) Int. Cl.

| | |
|---|---|
| ***C22C 38/04*** | (2006.01) |
| ***C22C 38/12*** | (2006.01) |
| ***C22C 1/04*** | (2006.01) |
| ***B22F 3/12*** | (2006.01) |

(52) U.S. Cl.
CPC ..... *C22C 33/0207* (2013.01); *C22C 38/04* (2013.01); *C22C 38/12* (2013.01); *B22F 2998/10* (2013.01); *B22F 2999/00* (2013.01)

(58) Field of Classification Search
USPC ..... 420/429, 123; 75/623
See application file for complete search history.

(56) References Cited

U.S. PATENT DOCUMENTS

| | | | | |
|---|---|---|---|---|
| 2001/0018852 | A1* | 9/2001 | Ando | C22C 33/0207 75/228 |
| 2002/0043131 | A1 | 4/2002 | Nakamura et al. | |
| 2004/0103753 | A1 | 6/2004 | Ando | |
| 2006/0219054 | A1 | 10/2006 | Kawata et al. | |
| 2010/0263766 | A1* | 10/2010 | Saw | B22F 9/005 148/403 |
| 2012/0304821 | A1 | 12/2012 | Ando et al. | |

FOREIGN PATENT DOCUMENTS

| | | | |
|---|---|---|---|
| DE | 603 06 300 | T2 | 5/2007 |
| GB | 1 504 547 | A | 3/1978 |
| JP | 05-039508 | A | 2/1993 |
| JP | 2001-181807 | A | 7/2001 |
| JP | 2002-146403 | A | 5/2002 |
| JP | 2011-190526 | A | 9/2011 |

* cited by examiner

FIG. 1

| | HARD PARTICLE COMPONENTS, MASS% (BALANCE = IRON AND UNAVOIDABLE IMPURITIES) | | | | | | | INITIAL OXIDATION TEMPER-ATURE (°C) | HARD-NESS Hv | PROCESS | PARTICLE DIAMETER |
|---|---|---|---|---|---|---|---|---|---|---|---|
| | Mo | Mn | Ni | Co | Cr | C | Si | | | | |
| EXAMPLE 1 | 22 | 6 | | | | | | 690 | 230 | GAS ATOMIZATION | 45-180 μm |
| EXAMPLE 2 | 40 | 6 | | | | | | 600 | 250 | GAS ATOMIZATION | 45-180 μm |
| EXAMPLE 3 | 55 | 6 | | | | | | 515 | 400 | GAS ATOMIZATION | 45-180 μm |
| EXAMPLE 4 | 40 | 3 | | | | | | 630 | 240 | GAS ATOMIZATION | 45-180 μm |
| EXAMPLE 5 | 40 | 12 | | | | | | 600 | 290 | GAS ATOMIZATION | 45-180 μm |
| EXAMPLE 6 | 40 | 6 | | | | 0.4 | | 630 | 500 | GAS ATOMIZATION | 45-180 μm |
| EXAMPLE 7 | 40 | 6 | | | | 0.02 | | 607 | 247 | GAS ATOMIZATION | 45-180 μm |
| COMPARATIVE EXAMPLE 1 | 40 | 6 | | | | 1.5 | | 640 | 1200 | GAS ATOMIZATION | 45-180 μm |
| COMPARATIVE EXAMPLE 2 | 15 | 6 | | | | | | 790 | 200 | GAS ATOMIZATION | 45-180 μm |
| COMPARATIVE EXAMPLE 3 | 70 | 6 | | | | | | 500 | 750 | GAS ATOMIZATION | 45-180 μm |
| COMPARATIVE EXAMPLE 4 | 40 | 6 | 12 | | | 1.5 | | 600 | 790 | GAS ATOMIZATION | 45-180 μm |
| COMPARATIVE EXAMPLE 5 | 63 | | | | | | 1.1 | 580 | 1000 | PULVERIZATION | NOT MORE THAN 150 μm |
| COMPARATIVE EXAMPLE 6 | 28 | | 0.3 | 60 | 9 | 0.07 | 2.2 | 750 | 850 | GAS ATOMIZATION | 45-180 μm |

FIG. 2

| | HARD PARTICLE COMPONENTS (MASS%) | | | | | | | MIXING PROPORTIONS IN THE STARTING POWDER FOR SINTERING (MASS%) | | | COMPONENTS OF THE SINTERED ARTICLE | RESULTS OF THE INDIVIDUAL TESTS | | |
|---|---|---|---|---|---|---|---|---|---|---|---|---|---|---|
| | Mo | Mn | Ni | Co | Cr | C | Si | HARD PARTICLES | IRON POWDER | GRAPHITE | | TENSILE TEST (MPa) | AMOUNT OF WEAR (μm) | HARDNESS OF THE HARD PARTICLES (Hv) |
| EXAMPLE 8 | 40 | 6 | | | | | | 20 | 79 | 1 | Fe-8Mo-1.2Mn-1C | 425 | 0.12 | |
| EXAMPLE 9 | 40 | 6 | | | | | | 20 | 78.5 | 1.5 | Fe-8Mo-1.2Mn-1.5C | 460 | | |
| EXAMPLE 10 | 40 | 6 | | | | | | 20 | 78 | 2 | Fe-8Mo-1.2Mn-2C | 440 | | |
| EXAMPLE 11 | 40 | 6 | | | | | | 30 | 69 | 1 | Fe-12Mo-1.8Mn-1C | 289 | | |
| EXAMPLE 12 | 40 | 6 | | | | | | 30 | 68.5 | 1.5 | Fe-12Mo-1.8Mn-1.5C | 354 | | |
| EXAMPLE 13 | 40 | 6 | | | | | | 30 | 68 | 2 | Fe-12Mo-1.8Mn-2C | 340 | | |
| EXAMPLE 14 | 40 | 6 | | | | | | 40 | 59.5 | 0.5 | Fe-16Mo-2.4Mn-0.5C | 200 | 0.1 | |
| EXAMPLE 15 | 40 | 6 | | | | | | 40 | 59 | 1 | Fe-16Mo-2.4Mn-1C | 230 | 0.08 | 890 |
| EXAMPLE 16 | 40 | 6 | | | | | | 40 | 58.5 | 1.5 | Fe-16Mo-2.4Mn-1.5C | 262 | | 820 |
| EXAMPLE 17 | 40 | 6 | | | | | | 40 | 58 | 2 | Fe-16Mo-2.4Mn-2C | 250 | | 620 |
| EXAMPLE 18 | 40 | 6 | | | | | | 55 | 44.5 | 0.5 | Fe-22Mo-3.3Mn-0.5C | 185 | | |
| EXAMPLE 19 | 40 | 6 | | | | | | 55 | 44 | 1 | Fe-22Mo-3.3Mn-1C | 200 | | |
| EXAMPLE 20 | 22 | 6 | | | | | | 40 | 58.5 | 1.5 | Fe-8.8Mo-2.4Mn-1.5C | 350 | 0.15 | |
| EXAMPLE 21 | 55 | 6 | | | | | | 40 | 58.5 | 1.5 | Fe-22Mo-2.4Mn-1.5C | 210 | | |
| EXAMPLE 22 | 40 | 3 | | | | | | 40 | 58.5 | 1.5 | Fe-16Mo-2.4Mn-1.5C | 250 | | |
| EXAMPLE 23 | 40 | 12 | | | | | | 40 | 58.5 | 1.5 | Fe-16Mo-4.8Mn-1.5C | 265 | | |
| EXAMPLE 24 | 40 | 6 | | | | 0.4 | | 40 | 58.5 | 1.5 | Fe-16Mo-2.4Mn-1.7C | 245 | | |
| EXAMPLE 25 | 40 | 6 | | | | 0.02 | | 40 | 58.5 | 1.5 | Fe-16Mo-2.4Mn-1.5C | 262 | | 823 |
| COMPARATIVE EXAMPLE 7 | 40 | 6 | | | | 1.5 | | 40 | 59.4 | 0.6 | Fe-16Mo-2.4Mn-1.2C | 170 | 0.15 | 960 |
| COMPARATIVE EXAMPLE 8 | 70 | 6 | | | | | | 40 | 59 | 1 | Fe-28Mo-2.4Mn-1C | 150 | | |
| COMPARATIVE EXAMPLE 9 | 15 | 6 | | | | | | 40 | 59 | 1 | Fe-6Mo-2.4Mn-1C | 400 | 0.2 | |
| COMPARATIVE EXAMPLE 10 | 40 | | | | | 1.5 | | 40 | 59 | 1 | Fe-16Mo-1C | 120 | | |
| COMPARATIVE EXAMPLE 11 | 40 | 6 | | | | | | 65 | 34 | 1 | Fe-26Mo-2.7Mn-1C | 90 | | |
| COMPARATIVE EXAMPLE 12 | 40 | 6 | | | | | | 10 | 89 | 1 | Fe-4Mo-0.6Mn-1C | 450 | 0.25 | |
| COMPARATIVE EXAMPLE 13 | 40 | 6 | | | | | | 40 | 60 | 0 | Fe-16Mo-2.4Mn | 125 | 0.2 | 930 |
| COMPARATIVE EXAMPLE 14 | 40 | 6 | | | | | | 40 | 57 | 3 | Fe-16Mo-2.4Mn-3C | 180 | | |
| COMPARATIVE EXAMPLE 15 | 40 | 6 | 12 | | | 1.5 | | 40 | 59.4 | 0.6 | Fe-16Mo-4.6Ni-2.4Mn-1.2C | 260 | 0.1 | |
| COMPARATIVE EXAMPLE 16 | 63 | | | | | | 1.1 | 40 | 59.4 | 0.6 | | 85 | 0.3 | 1050 |
| COMPARATIVE EXAMPLE 17 | 28 | | 0.3 | 60 | 9 | 0.07 | 2.2 | 40 | 59.4 | 0.6 | | 160 | 0.8 | 850 |

HARD PARTICLES FOR INCORPORATION IN SINTERED ALLOY AND WEAR-RESISTANT IRON-BASED SINTERED ALLOY AND PRODUCTION METHOD THEREOF

BACKGROUND OF THE INVENTION

1. Field of the Invention

The invention relates to hard particles suitable for incorporation in sintered alloys. The invention particularly relates to hard particles suitable for increasing the wear resistance of sintered alloys, to a wear-resistant iron-based sintered alloy that contains the hard particles, and to a method of producing this sintered alloy.

2. Description of Related Art

Sintered alloys having a ferrous matrix are conventionally used in, for example, valve seats. Hard particles can be incorporated into sintered alloys in order to further raise the wear resistance of the sintered alloy. The hard particles are generally incorporated into sintered alloys as follows. A powder of the hard particles is mixed into a powder having a low-alloy steel or stainless steel composition to obtain a mixed powder. A green compact is formed with this mixed powder. The green compact is subsequently sintered to make the sintered alloy.

Japanese Patent Application Publication No. 2001-181807 (JP 2001-181807 A) describes hard particles that contain, expressed as mass %, Mo: 20 to 60%, C: 0.2 to 3%, Ni: 5 to 40%, Mn: 1 to 15%, and Cr: 0.1 to 10% with the balance being Fe and unavoidable impurities. It is also stated here that, for example, Co may be added to these hard particles.

Using these hard particles, the adherence between the hard particles and the ferrous matrix that is the base material can be improved when a ferrous-matrix sintered alloy is produced. In addition, adhesive wear can be inhibited because an oxidation film is formed from the Mo at the hard particles.

The amount of Mo in solid solution in the hard particles can be raised by the addition of Ni to the hard particles described in JP 2001-181807 A. This functions to improve the oxidation characteristics of the added Mo and can thereby improve the wear resistance. In addition, Co has a low stacking fault energy and due to this the addition of Co to the hard particles can raise the hardness of the hard particles and improve the wear resistance. However, the moldability into the green compact can be impaired when the hardness of the hard particles has been raised prior to compaction by the addition of Co. Furthermore, this Ni and Co are more expensive than other elements, resulting in high raw material costs for hard particles to which Ni and/or Co has been added.

Considering these points, for example, ferromolybdenum (Fe—Mo—Si) hard particles have a low cost because they do not contain cobalt or nickel. In the case of ferromolybdenum (Fe—Mo—Si) hard particles, the hard particles themselves have a high hardness due to the incorporation of Si. However, an Si oxidation film is formed when ferromolybdenum is compacted with an iron-based powder as the matrix and sintered. The formation of the Si oxidation film may cause that solid-solution diffusion between the hard particles and the ferrous matrix during sintering is hindered as a consequence. The adhesive strength of the hard particles for the ferrous matrix may then be lowered and the wear resistance of the sintered alloy may be lowered. In addition, because oxidation of the Mo is inhibited by the oxidation of the Si, the formation of an oxidation film of Mo at the hard particle is impeded. As a result, adhesive wear may ultimately be promoted due to exposure of the iron due to rupture of the Si oxidation film during sliding.

SUMMARY OF THE INVENTION

The invention provides hard particles for incorporation in sintered alloys, that can inexpensively increase the wear resistance of the sintered alloy provided by the sintering of the green compact while raising the moldability into the green compact prior to sintering. The invention further provides a wear-resistant iron-based sintered alloy that contains the hard particles and a method of producing this sintered alloy.

It is desirable to raise the amount of C in solid solution in order, without using Co, to raise the hardness of the hard particles incorporated in a sintered alloy. However, when the amount of C in solid solution is raised during production of the hard particles, a carbide is then formed with the Mo and the production of Mo oxide may be inhibited as a result. Furthermore, the moldability during compaction is impaired when the hardness of the hard particles is too high prior to compaction, and as a consequence the mechanical strength of the obtained sintered alloy may ultimately decline.

A first aspect of the invention relates to hard particles for incorporation in sintered alloys. The hard particles incorporated as a starting material in the sintered alloy consist of 20 to 60 mass % Mo, 3 to 15 mass % Mn, and the balance consisting of Fe and unavoidable impurities.

Because the hard particles do not contain C and do not contain Co, the hard particles of the invention are softer than conventional hard particles for incorporation in sintered alloys. As a consequence, the density of the molding is raised during compaction and the area of contact with the iron-based powder that is the matrix starting material is increased, and as a result the diffusion of iron from the ferrous matrix into the hard particles is increased. The adherence of the hard particles to the ferrous matrix is thereby increased and the mechanical strength of the sintered alloy can then be increased.

The Mo present in the hard particles forms an Mo carbide, resulting in an increase in the hardness of the hard particles and in the wear resistance. Moreover, since the Mo carbide and the Mo in solid solution in the hard particles form an Mo oxidation film, the Mo is effective for raising the solid lubricity. When the amount of Mo is less than the lower limit value indicated above, the solid lubricity due to the Mo oxidation film at the hard particles is inadequate and adhesive wear of the sintered alloy is promoted. When the upper limit value indicated above is exceeded, the adherence with the ferrous matrix upon sintering declines. This results in a decline in the mechanical strength of the sintered alloy.

During sintering, the Mn present in the hard particles efficiently diffuses from the hard particles into the matrix of the sintered alloy and as a consequence is effective for improving the adherence between the hard particles and the matrix. The Mn also brings about an increase in the austenite in the matrix.

When the Mn content is much lower than the lower limit value indicated above, little diffusion into the matrix occurs and the adherence between the hard particles and the matrix is reduced. The density of the sintered alloy declines when the Mn content is much higher than the upper limit value indicated above.

A second aspect of the invention relates to hard particles for incorporation in sintered alloys. The hard particles incorporated as a starting material in the sintered alloy consist of 20 to 60 mass % Mo, 3 to 15 mass % Mn, more than 0.01 to 0.5 mass % C, and the balance consisting of Fe and unavoidable impurities.

The production of a carbide by the C and Mo is inhibited in the hard particles due to the limitation of the amount of C addition to not more than 0.5 mass %. As a consequence, the amount of Mo in solid solution in the hard particle can be increased even in the absence of the addition of Ni.

The formation of a carbide between Mo and C readily occurs when the amount of C addition exceeds 0.5 mass %. As a result, the hard particles become harder and the compactability is then impaired and the adherence with the ferrous matrix is reduced. The mechanical strength of the sintered alloy may decline as a consequence.

A third aspect relates to a wear-resistant iron-based sintered alloy provided by mixing, a powder composed of the above hard particles with an iron-based powder that becomes the matrix, so as to disperse the hard particles, and sintering. The sintered alloy contains 15 to 60 mass % hard particles.

According to the third aspect, both the mechanical strength of the sintered alloy and its wear resistance can be improved because the sintered alloy contains 15 to 60 mass % hard particles with reference to the sintered alloy.

When the hard particle content here is less than 15 mass % with reference to the sintered alloy, the effect on the wear resistance due to the hard particles may not be satisfactorily manifested due to an inadequate hard particle content. The proportion of the ferrous matrix is reduced when, on the other hand, the hard particle content exceeds 60 mass % with reference to the sintered alloy. As a result, it may not be possible to retain the hard particles in the sintered alloy at an adequate adhesive strength. As a consequence, the hard particles may escape from the sintered alloy in an environment where wear is generated, e.g., a contact/sliding environment, and wear of the sintered alloy may then be promoted.

A forth aspect relates to a method of producing a wear-resistant iron-based sintered alloy that uses the above-described hard particles for incorporation in sintered alloys. In the method according to the forth aspect for producing a sintered alloy, a mixed powder is produced by mixing an iron-based powder that becomes the matrix with 0.2 to 2 mass % graphite powder and 15 to 60 mass % of a powder composed of the above-described hard particles. This mixed powder is compacted and subsequently sintered while diffusing a carbon (C) in the graphite powder into the hard particles.

The wear resistance of the sintered alloy and its mechanical strength are increased by having the hard particle powder content be 15 to 60 mass % in accordance with this production method. In addition, the hardness of the hard particles can be raised because the C in the graphite powder diffuses into the hard particles.

A valve seat may be formed using the thusly structured sintered alloy. A mixed wear mode of adhesive wear during contact, as described above, and abrasive wear during sliding may occur in a high-temperature environment. Even in such a case, the hardness of the hard particles can be raised for the valve seat without impairing the already existing solid lubricity of the hard particles. As a result, the wear resistance of the valve seat can be even more substantially improved over that heretofore available.

The invention can inexpensively increase the wear resistance of the sintered alloy, provided by the sintering of the green compact while raising the moldability into the green compact prior to sintering.

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

FIG. 1 is a table for describing the hard particles according to Examples 1 to 7 and Comparative Examples 1 to 6;

FIG. 2 is a table for describing the sintered alloys according to Examples 8 to 25 and Comparative Examples 7 to 17.

DETAILED DESCRIPTION OF EMBODIMENTS

Figure 3:
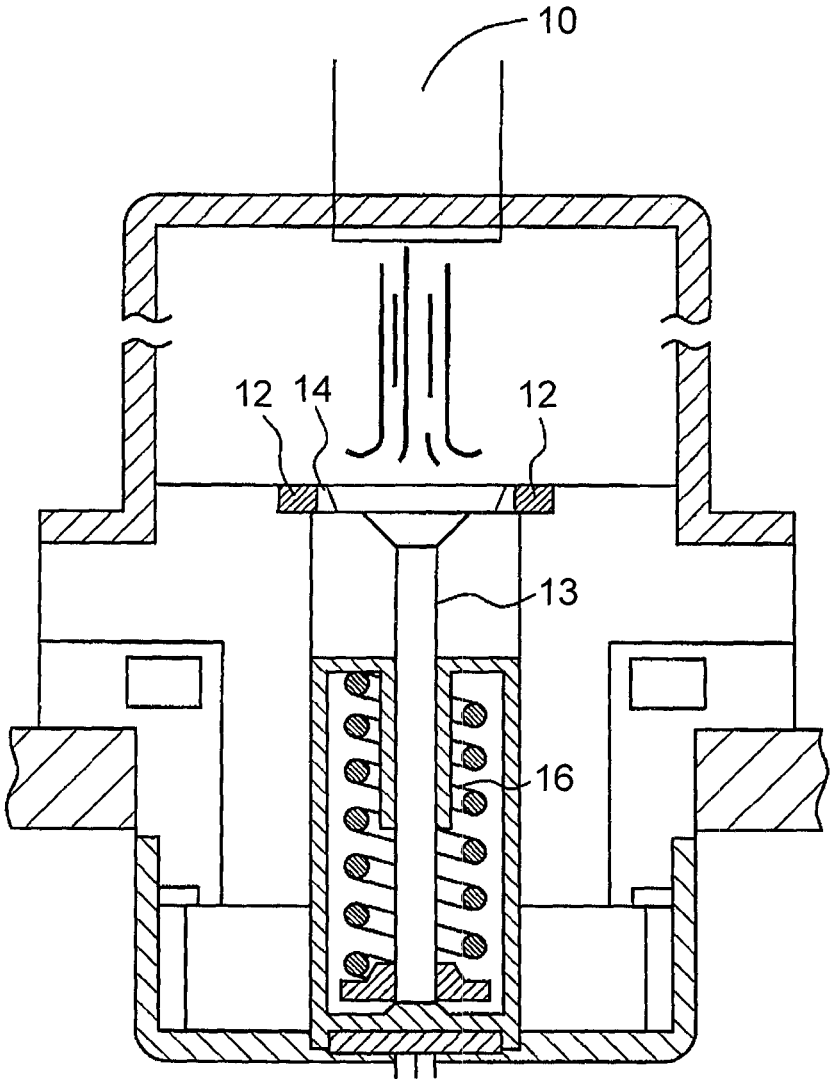
FIG. 3 is a diagram for describing the wear test in the examples and comparative examples.

The hard particles of this embodiment are hard particles for incorporation in a sintered alloy, that are incorporated as a starting material in a sintered alloy. The hard particles of this embodiment have a higher hardness than the matrix of the sintered alloy. The hard particles are composed of 20 to 60 mass % Mo and 3 to 15 mass % Mn with the balance being Fe and unavoidable impurities.

These hard particles can be produced by an atomization process in which a melt with the composition indicated above is atomized. In another method for producing the hard particles, a solid provided by the solidification of the melt is converted into the powder by mechanical pulverization. A gas atomization process or a water atomization process may be selected for the atomization process. Production of the hard particles by the gas atomization process provides, inter alia, an excellent sintering behavior because round hard particles are obtained, and the gas atomization process is therefore more preferred.

The lower and upper limits for the composition of the hard particles can be changed to suitable values. These suitable values can be determined in conformity to the reasons for the composition limitations described in the following, as well as in conformity to the hardness, solid lubricity, adherence; and cost and the importance of the various properties of the target part or structure.

First, considering the Mo in the composition of the hard particles, due to the formation of Mo carbide the hardness of the hard particles is increased and the wear resistance is increased. Moreover, the Mo carbide and the Mo in solid solution in the hard particles form an Mo oxidation film and as a consequence the Mo is effective for improving the solid lubricity.

When the Mo content is less than 20 mass %, the hard particles have a high initial oxidation temperature and the production of Mo oxide is inhibited. The wear resistance of the sintered metal ultimately declines as a result. When, on the other hand, the Mo content exceeds 60 mass %, the adherence between the hard particles and the ferrous matrix when sintering occurs is diminished. A more preferred Mo content for the hard particle is 22 to 55 mass %.

The Mn in the composition of the hard particles efficiently diffuses during sintering from the hard particles to the matrix of the sintered alloy and as a consequence is effective for improving the adherence between the hard particles and the matrix. The Mn is also thought to be effective for increasing the austenite in the matrix.

When the Mn content is less than 20 mass %, little Mn diffuses into the matrix and the adherence between the hard particles and the matrix declines as a result. The density of the sintered alloy declines when the Mn content is much higher than the upper limit indicated above. A more preferred Mn content for the hard particles is 3 to 12 mass %.

The C in the composition of the hard particles forms an Mo carbide by bonding with Mo and is therefore effective for raising the hardness of the hard particles and the wear resistance. However, due to the limitation on the amount of C addition, the hard particles in this embodiment are softer than conventional hard particles. As a result, the density of the molding from compaction can be increased and the area of contact with the iron-based powder that is the matrix starting material is increased, and as a consequence the diffusion of iron from the ferrous matrix into the hard particles is increased. This functions to raise the mechanical strength of the sintered alloy.

Moreover, the limitation on the addition of C to the hard particles makes it possible to inhibit the production of Mo carbide while increasing the amount of Mo in solid solution without incorporating, for example, Ni. The formation of an Mo oxidation film is facilitated as a consequence. The wear resistance of the obtained sintered alloy, can be improved as a result.

Here, when C is incorporated in the hard particles, preferably not more than 0.5 mass % C is incorporated. The hardness of the hard particles can be increased by the addition of C to the hard particles. The production of a carbide of Mo and C is suppressed by limiting the C added to the hard particles to not more than 0.5 mass %. The amount of Mo in solid solution in the hard particles can be raised even without the addition of Ni.

The average particle diameter of the hard particles can be selected as appropriate in conformity to, inter alia, the type and application of the iron-based sintered alloy. For example, the average particle diameter of the hard particles can be 20 to 250 μm.

The hard particles are mixed with the iron-based powder so as to disperse the powder composed of the hard particles for incorporation in a sintered alloy in the iron-based powder that forms the matrix. The hard particle content at this time is more preferably 10 to 60 mass % with reference to the mixed powder as a whole.

Through their dispersion in the matrix of the sintered alloy, the hard particles constitute a hard phase that raises the wear resistance of the sintered alloy. The wear resistance of the sintered alloy will not be satisfactory when the proportion of hard particles with reference to the sintered alloy is less than 10 mass %. When the proportion of the hard particles with reference to the sintered alloy exceeds 60 mass %, the sintered alloy exhibits an increased aggressiveness for an opposing part or structure, and in addition retention of the hard particles in the sintered alloy is impaired.

The mixed powder contains 15 to 60 mass % powder composed of the hard particles and 0.2 to 2 mass % graphite powder and, for the balance of the powder, contains an iron-based powder (for example, a pure iron powder or a low-alloy steel powder) that becomes the matrix of the wear-resistant iron-based sintered alloy. The low-alloy steel powder is, for example, an Fe—C-based powder. This low-alloy steel powder is composed, for example, of 0.2 to 5 mass % C with the balance being Fe and unavoidable impurities, where 100 mass % is the low-alloy steel powder.

The mixed powder is molded into a green compact. As has been indicated above, the hard particles of this embodiment are softer than conventional hard particles. As a consequence, the hard particles of this embodiment provide an increased density for the molding produced by compaction and can bring about an increase in the contact area with the iron-based powder that is the matrix starting material.

This green compact is sintered. At this point, the diffusion of iron from the ferrous matrix into the hard particles is increased. In addition, because the carbon addition to the hard particles is more limited than for conventional hard particles, the carbon in the graphite powder diffuses into the hard particles and the hard particles then undergo an increase in their hardness.

A sintering temperature of about 1050 to 1250° C. and particularly about 1100 to 1150° C. can be used. The sintering time at these sintering temperatures can be 30 minutes to 120 minutes and more preferably 45 to 90 minutes. A nonoxidizing atmosphere, for example, an inert gas atmosphere, can be used as the sintering atmosphere. A nitrogen atmosphere, an argon gas atmosphere, or a vacuum atmosphere can be used for the nonoxidizing atmosphere.

In addition, the matrix of the iron-based sintered alloy yielded by sintering preferably contains a pearlite-containing structure in order to ensure its hardness. The pearlite-containing structure may be a pearlite structure, a pearlite-austenite mixed structure, a pearlite-ferrite mixed structure, or a pearlite-cementite mixed structure. The content of low-hardness ferrite is preferably low in order to ensure the wear resistance. The hardness of the matrix can be about Hv 120 to 300. The hardness of the matrix can be adjusted through, for example, the composition of the matrix, the heat treatment conditions, and the amount of addition of the carbon powder. This composition and hardness are not limited to the numerical value ranges indicated above as long as the adherence between the hard particles and matrix is not diminished and as long as the wear resistance is not lowered. The method described above can provide a sintered alloy composed of about 6 to 25 mass % Mo, about 1 to 5 mass % Mn, and not more than 2 mass % C, with the balance being iron and unavoidable impurities.

The valve seat of the exhaust valve of an internal combustion engine is formed by the aforementioned sintered alloy in this embodiment. The valve seat of the exhaust valve of an internal combustion engine is used in a high-temperature atmosphere. As a consequence, the wear occurring at the valve seat is a combination of adhesive wear when the valve and valve seat are in contact and abrasive wear due to sliding between the valve seat and the valve. Even in such a case the hardness of the hard particles can be increased without impairing the solid lubricity of the hard particles. The wear resistance of the valve seat can as a result be further improved over that conventionally available.

Examples that specifically execute the invention are described in the following together with comparative examples.

Examples 1 to 7

Powders composed of hard particles were prepared by the method described in the following. The hard particles are composed of 20 to 60 mass % Mo, 3 to 15 mass % Mn, and 0 to 0.5 mass % C, with the balance being Fe and unavoidable impurities. An alloy powder was produced by carrying out a gas atomization process using an inert gas (nitrogen gas) on a melt having the composition shown in FIG. 1. Classification of the alloy powder into the 45 μm to 180 μm range then produced a powder of the hard particles.

Comparative Example 1

A powder composed of hard particles was produced as in Examples 1 to 7. The difference between Comparative Example 1 and Examples 1 to 7 is that, 1.5 mass % C was added in the former case in order to be outside the range of 0 to 0.5 mass % C.

Comparative Examples 2 and 3

Powders composed of hard particles were produced as in Examples 1 to 7. The differences between Comparative Examples 2 and 3 and Examples 1 to 7 were that 15 mass % Mo was added in Comparative Example 2 and 70 mass % Mo was added in Comparative Example 3, in order in each case to be outside the range of 20 to 60 mass % Mo.

Comparative Example 4

A powder composed of hard particles was produced as in Examples 1 to 7. The differences between Comparative Example 4 and Examples 1 to 7 were that in the former case 1.5 mass % C was added in order to be outside the range of 0 to 0.5 mass % C and 12 mass % Ni was also added.

Comparative Example 5

A powder composed of hard particles was produced as in Examples 1 to 7. The differences between Comparative Example 5 and Examples 1 to 7 were as follows: alloy lumps were produced that contained 63 mass % Mo, in order to be outside the range of 20 to 60 mass % Mo, and that additionally contained 1.1 mass % Si; also, production was carried out by pulverization of the alloy lumps. Conventional ferromolybdenum hard particles are produced by the production method of Comparative Example 5.

Comparative Example 6

A powder composed of hard particles was produced as in Examples 1 to 7. The difference between Comparative Example 6 and Examples 1 to 7 was that the hard particles were produced based on the production conditions given for Comparative Example 6 in FIG. 1.

<Measurement of the Initial Oxidation Temperature>

The hard particle powders according to Examples 1 to 7 and Comparative Examples 1 to 6 were heated in the atmosphere in order to bring about oxidation and the temperature at which the weight gain accompanying oxidation exhibited a sharp onset was measured. This temperature at which the weight gain exhibited a sharp onset was taken to be the temperature at which oxidation started. These results are given in FIG. 1.

<Hardness Testing>

The hardness of the hard particles according to Examples 1 to 7 and Comparative Examples 1 to 6 was measured using a micro Vickers hardness tester and a measurement load of 0.98 N (0.1 kgf). These results are given in FIG. 1.

[Result 1]

As shown in FIG. 1, an oxidation film is more readily formed by the Mo with the hard particles according to Examples 2 to 7 than with the hard particles according to Comparative Example 1. The reason for this is thought to be the absence of C addition or the addition of only a small amount of C.

In addition, the hard particles according to Examples 1 to 7 have a lower hardness than the hard particles of Comparative Examples 1 and 4. The reason for this is thought to be that the formation of Mo carbide in the hard particles is impeded due to the absence of C addition or the addition of only a small amount of C.

Silicon is added to the hard particles according to Comparative Example 5 and Co is added to the hard particles according to Comparative Example 6. This is thought to have provided the hard particles according to Comparative Examples 5 and 6 with a higher hardness than the hard particles according to Examples 1 to 7. Based on this, the hard particles according to Examples 1 to 7 are considered to have a higher moldability during compaction than the hard particles according to Comparative Examples 1 and 3 to 6.

In addition, the hard particles according to Examples 1 to 7 have a lower initial oxidation temperature than the hard particles of Comparative Example 6 and thus have an increased oxidizability. The reasons for this are the increased amount of Mo, which has a low initial oxidation temperature (approximately 340° C. for a particle size of 80 to 200 mesh), and the reduced amount of Cr, which has a high initial oxidation temperature (approximately 500° C. for a particle size of 145 mesh).

The hard particles according to Comparative Example 2 have a lower Mo content than in Examples 1 to 7, and as a consequence the formation of an Mo oxidation film is impeded. The wear resistance of the sintered alloy ends up being reduced as a consequence (refer to Comparative Example 9 below).

Examples 8 to 19

A mixed powder was prepared by mixing the following: 15 to 60 mass % of a powder composed of the hard particles according to Example 2 as described above and 0.2 to 2 mass % graphite powder with the balance being a pure iron powder that will form the matrix. Specifically, the powder composed of the hard particles, the graphite powder, and the pure iron powder were mixed in the proportions shown in FIG. 2 using a mixer to prepare a mixed powder serving as a mixed starting material.

The mixed powder blended as described above was introduced into a mold and was compressed at a compression force of $78.4\times10^7$ Pa (8 tonf/cm$^2$) to form a ring-shaped green compact (test specimen). The green compact was sintered for 60 minutes in an inert atmosphere (nitrogen gas atmosphere) at 1120° C. to form a sintered alloy (valve seat) corresponding to the test specimen.

Examples 20 to 25

Sintered alloys (valve seats) were fabricated proceeding as in Examples 8 to 19. Examples 20 to 25 differed from Examples 8 to 19 mainly on two points. Examples 20 to 25 used the hard particles according to Examples 1 and 3 to 7. In Examples 20 to 25, the sintered alloys were fabricated by mixing the powder composed of the hard particles, the graphite powder, and the pure iron powder in the proportions shown in FIG. 2 followed by sintering.

Comparative Example 7

A sintered alloy (valve seat) was fabricated proceeding as in Examples 8 to 19. Comparative Example 7 differed from Examples 8 to 19 in that it used a powder composed of the hard particles of Comparative Example 1 (hard particles to which 1.5 mass % C had been added, so as to be outside the range of 0 to 0.5 mass % C) as the hard particles.

Comparative Example 8

A sintered alloy (valve seat) was fabricated proceeding as in Examples 8 to 19. Comparative Example 8 differed from Examples 8 to 19 in that it used a powder composed of the hard particles of Comparative Example 3 (hard particles to which 70 mass % Mo had been added, so as to be outside the range of 20 to 60 mass % Mo) as the hard particles.

Comparative Example 9

A sintered alloy (valve seat) was fabricated proceeding as in Examples 8 to 19. Comparative Example 9 differed from Examples 8 to 19 in that it used a powder composed of the hard particles of Comparative Example 2 (hard particles to which 15 mass % Mo had been added, so as to be outside the range of 20 to 60 mass % Mo) as the hard particles.

Comparative Example 10

A sintered alloy (valve seat) was fabricated proceeding as in Examples 8 to 19. The difference from Examples 8 to 19 resided in the use of a powder composed of hard particles that contained 40 mass % Mo, 0 mass % Mn, and 1.5 mass % C (hard particles prepared to be outside the range of 3 to 15 mass % Mn) as the hard particles. Comparative Example 10 corresponds to the hard particles shown in the previously described JP 2001-181807 A.

Comparative Examples 11 and 12

Sintered alloys (valve seats) were fabricated proceeding as in Examples 8 to 19. The difference from Examples 8 to 19 is that the proportion of the hard particle powder relative to the mixed powder was set outside 15 to 60 mass % as shown in FIG. 2. The proportion of the hard particle powder was 65 mass % in Comparative Example 11, while the proportion of the hard particle powder was 10 mass % in Comparative Example 12.

Comparative Examples 13 and 14

Sintered alloys (valve seats) were fabricated proceeding as in Examples 8 to 19. The difference from Examples 8 to 19 is that the proportion of the graphite powder relative to the mixed powder was set outside 0.2 to 2 mass % as shown in FIG. 2. The proportion of the graphite powder was 0 mass % in Comparative Example 13, while the proportion of the graphite powder was 0.3 mass % in Comparative Example 14.

Comparative Examples 15 to 17

Sintered alloys (valve seats) were fabricated proceeding as in Examples 8 to 19. Comparative Examples 15 to 17 differed from Examples 8 to 19 by their use of the hard particles according to Comparative Examples 4 to 6.

<Tensile Testing>

Test pieces of the sintered alloys according to Examples 8 to 25 and Comparative Examples 7 to 17 were fabricated. The tensile strength was measured by carrying out tensile testing (20° C. condition) on the test pieces in accordance with JIS Z 2241. These results are given in FIG. 2.

<Wear Test>

The wear resistance was evaluated by carrying out wear testing on the sintered alloys according to Examples 8, 14, 15, and 20 and Comparative Examples 7, 9, and 12 to 17 using a test device in FIG. 3. In this wear test, as shown in FIG. 3, a propane gas burner 10 was used as a heat source and a propane gas combustion atmosphere was established for a sliding region between a ring-shaped valve seat 12 composed of the sintered alloy fabricated as described above and a valve face 14 of a valve 13. The valve face 14 had been subjected to a soft nitriding treatment to SUH 11. The temperature of the valve seat 12 was controlled to 250° C., and a load of 176 N (18 kgf) was applied by a spring 16 when the valve seat 12 was in contact with the valve face 14. The valve seat 12 and the valve face 14 were brought into contact at a rate of 2000 times/minute, and the wear test was run for 8 hours. The results are shown in FIG. 2.

<Hardness Test>

The hardness of the hard particles for the sintered alloys according to Examples 15 to 17, and 25 and Comparative Examples 7, 13, 16, and 17 was measured using a micro Vickers hardness tester at a measurement load of 0.98 N (0.1 kgf). These results are given in FIG. 2.

[Result 2: The Amount of Addition for Each Element]

The sintered alloys according to Examples 8 to 25 exhibited higher tensile strengths than the sintered alloys according to Comparative Examples 7 and 8, which used hard particles to which large amounts of Mo or C had been added. The reason for this is presumed to be that the moldability of the green compact was improved because the hard particles (hard particles according to Examples 1 to 7) used in the sintered alloys according to Examples 8 to 25 were softer than the hard particles (hard particles according to Comparative Examples 1 and 3) used in the sintered alloys according to Comparative Examples 7 and 8.

The sintered alloy according to Comparative Example 15, which used the hard particles according to Comparative Example 4, had a higher tensile strength than in Comparative Example 7, which lacked the Ni provided by diffusion into the matrix of Ni present in the hard particles. The sintered alloy according to Example 16, notwithstanding its lack of Ni, had almost the same tensile strength as in Comparative Example 15.

The hard particles according to Example 2 were used in the sintered alloys according to Examples 15 to 17. The hardness of the hard particles according to Example 2 is higher after sintering. The reason for this is thought to be that, due to the limitation on the C content for the hard particles according to Example 2, the carbon from the graphite powder more easily undergoes solid-solution diffusion into the hard particles during sintering. On the other hand, the hardness of the hard particles is reduced post-sintering in the case of Comparative Example 7, which used the hard particles of Comparative Example 1. The reason for this is thought to be that the aforementioned phenomenon was almost entirely absent due to the larger C content in the hard particles according to Comparative Example 1 than in the hard particles according to Examples 1 to 7.

The hard particles according to Comparative Example 2 were used in the sintered alloy according to Comparative Example 9. The hard particles in Comparative Example 9 had a lower Mo content than the hard particles of Examples 1 to 7. This is thought to have resulted in the larger abrasive wear for the sintered alloy according to Comparative Example 9 in comparison to the sintered alloys according to Examples 1 to 7.

Based on these results, when C is added to the hard particles, its content is preferably not more than 0.5 mass % and more preferably is not more than 0.4 mass %. Moreover, the content of the Mo in the hard particles is preferably 20 to 60 mass % and is more preferably 22 to 55 mass %.

Hard particles not containing Mn were used in the sintered alloy according to Comparative Example 10. Elemental analysis was performed on the sintered alloys according to Example 15 and Comparative Example 10. The diffusion, of Mn into the ferrous matrix of the sintered alloy of Example 15 was seen, while the diffusion of Mn into the ferrous matrix of the sintered alloy of Comparative Example 10 was not observed. Based on these results, it is thought that the tensile strength of the sintered alloy is raised because the adhesive strength of the hard particles for the ferrous matrix could be raised by the diffusion of the Mn present in the hard particles into the ferrous matrix during sintering.

[Result 3: The Proportion of the Hard Particle Powder]

The proportion of the hard particles in the sintered alloy of Comparative Example 11 is larger than in Examples 8 to 25. As a consequence, contact between the hard particles is increased during compaction and the sinterability between the hard particles and the iron particles forming the matrix is reduced. This is thought to result in the reduction in the tensile strength of the sintered alloy according to Comparative Example 11. On the other hand, the proportion of the hard particles for the sintered alloy of Comparative Example 12 is smaller than in Examples 8 to 25. It can be presumed that this resulted in an inadequate development of the effect due to the hard, particles on the wear resistance. Given the preceding, the proportion of the hard particle powder with reference to the mixed powder preferably ranges from 15 to 60 mass % and more preferably ranges from 20 to 55 mass %.

[Result 4: The Proportion of the Graphite Powder]

The sintered alloy according to Comparative Example 13 has an increased amount of ferrite in the ferrous matrix because the proportion of graphite powder in this case is less than in Examples 8 to 25. In the case of the sintered alloy of Comparative Example 14, the proportion of graphite powder is larger than in Examples 8 to 25 and the C in the hard particles undergoes an increase and some melting occurs. In either case this is thought to have resulted in the decline in the tensile strength of the sintered alloy in Comparative Examples 13 and 14. Given the preceding, the proportion of the graphite powder is regarded as preferably ranging from 0.2 to 2 mass % and more preferably ranging from 0.5 to 2 mass %.

[Result 5]

The sintered alloys according to Comparative Examples 16 and 17 contain Si and as a consequence have a lower tensile strength than the sintered alloys of Examples 8 to 25. The adherence of the hard particles is thought to be lower for the sintered alloys of Comparative Examples 16 and 17 because their hard particles are harder than for the sintered alloys according to Examples 8 to 25. It is thought that this resulted in the larger amounts of wear for the sintered alloys according to Comparative Examples 16 and 17 than for the sintered alloys of Examples 8, 14, 15, and 20.

Embodiments of the invention have been particularly described in the preceding; however, the invention is not limited to or by these embodiments. Various design variations can be carried out.

The sintered alloy of the embodiments is well suited for use as the wastegate valve of a turbocharger or in the valve train (for example, the valve seat or valve guide) of a compressed natural gas- or liquefied petroleum gas-fueled engine, which are used in high-temperature environments.

The invention claimed is:

1. A hard particle for incorporation in a sintered alloy, consisting of:

20 to 60 mass % Mo;

3 to 15 mass % Mn; and the balance consisting of Fe and unavoidable impurities.

2. A wear-resistant iron-based sintered alloy obtained by:

obtaining a mixed powder by mixing, into an iron-based powder that becomes a matrix, a powder composed of the hard particles according to claim 1 so that the hard particles are dispersed; and sintering the mixed powder, wherein the wear-resistant iron-based sintered alloy comprises 15 to 60 mass % of the hard particles with reference to the wear-resistant iron-based sintered alloy.

3. A method of producing a wear-resistant iron-based sintered alloy, comprising:

obtaining a mixed powder in which an iron-based powder that becomes a matrix is mixed with 0.2 to 2 mass % graphite powder, and 15 to 60 mass % powder composed of the hard particles according to claim 1;

compacting the mixed powder; and sintering the compacted mixed powder while diffusing a carbon of the graphite powder into the hard particles.

* * * * *